United States Patent [19]

Simone

[11] 4,194,327

[45] Mar. 25, 1980

[54] MODULAR RETICULAR BEARING STRUCTURE FOR DOMED SHELTERS

[76] Inventor: Giovanni Simone, via Bacchiglione 14, Milan, Italy

[21] Appl. No.: 871,331

[22] Filed: Jan. 20, 1978

[30] Foreign Application Priority Data

Jan. 21, 1977 [IT] Italy ..... 19512 A/77

[51] Int. Cl.[2] ..... E04B 1/32

[52] U.S. Cl. ..... 52/86

[58] Field of Search ..... 52/80, 81, 82 M, 86, 52/DIG. 10

[56] References Cited

U.S. PATENT DOCUMENTS

| | | | |
|---|---|---|---|
| 1,619,518 | 3/1927 | Junkers | 52/86 |
| 1,976,188 | 10/1934 | Nozawa | 52/81 |
| 2,044,321 | 6/1936 | Nozawa | 52/86 |
| 2,047,644 | 7/1936 | Mopin | 52/80 |
| 2,060,387 | 11/1936 | Wallis | 52/81 |
| 3,557,501 | 1/1969 | Kolozsvary | 52/81 |
| 3,722,153 | 3/1973 | Baer | 52/81 |
| 3,871,143 | 3/1975 | Quick | 52/81 |
| 3,916,589 | 11/1975 | Richter | 52/81 |

FOREIGN PATENT DOCUMENTS

| | | | |
|---|---|---|---|
| 76644 | 10/1953 | Denmark | 52/86 |
| 651850 | 10/1937 | Fed. Rep. of Germany | 52/86 |
| 1120195 | 4/1956 | France | 52/80 |
| 1191776 | 10/1959 | France | 52/81 |
| 1484634 | 6/1967 | France | 52/81 |
| 39157 | 5/1965 | German Democratic Rep. | 52/86 |
| 18085 | of 1891 | United Kingdom | 52/86 |
| 340558 | 12/1930 | United Kingdom | 52/86 |
| 312028 | 7/1971 | U.S.S.R. | 52/81 |
| 494502 | 2/1975 | U.S.S.R. | 52/81 |

OTHER PUBLICATIONS

Domebook II, © 1971, pp. 88 and 112.

Geodesics by Edward Popko © 1968 pp. 15–18.

*Primary Examiner*—James A. Leppink

*Assistant Examiner*—Henry E. Raduazo

*Attorney, Agent, or Firm*—Browdy and Neimark

[57] ABSTRACT

A reticular structure for shelters having square or rectangular plan, realized by arranging a plurality of triangular modular frames, each of them comprising a polygonal mesh grid, defined by rigid struts of equal length. Each triangular modular frame is able to be inscribed in a portion of a right cylindrical surface, while the single meshes have the oblique struts inscribed in crossed geodetic lines following a cylindric helix with constant pitch.

10 Claims, 16 Drawing Figures

MODULAR RETICULAR BEARING STRUCTURE FOR DOMED SHELTERS

The present invention relates to a modular reticular bearing structure for domed shelters.

Various reticular bearing structures for the construction of domed shelters are known, produced by connecting together at the ends various rods assembled in a grid arrangement.

Such known structures have a number of disadvantages, however, including that of difficulty in erection, which often demands the use of scaffolding and supporting frameworks.

Furthermore, reticular structures in use today demand the use of a considerable quantity of material, so that they are heavy and expensive and, once built, they cannot, in general, be extended or reduced in size in accordance with needs which may arise later.

The object of the present invention is to provide a reticular bearing structure for domed shelters which can be easily and quickly erected, which calls for a minimal use of material, which is of low cost and still has considerable strength, which is suited to very varied requirements and is capable of being subsequently easily extended or reduced to comply with various requirements of use.

This problem is solved by the reticular bearing structure for domed shelters in accordance with the invention which is characterized by consisting of a plurality of triangular modular frames of curved section, forming a grid-like shell composed of triangular and/or rhomboidal rigid meshes, the rod-like oblique elements of which can be inscribed in crossing geodetic lines following a helical course, the said triangular frames being capable of being assembled to form domed shelters with a rectangular plan.

The advantages resulting from the invention reside particularly in the fact that, since the said modular frames can be assembled together, domed shelters can be very easily constructed in which all the oblique rod-like elements are inscribed in geodetic lines following a helical course, so as to produce considerable resistance with a minimum use of material.

Another advantage of the invention is the considerable flexibility in use of the modular frames to produce light and economic structures of very different types following architectural designs which can be varied as desired.

Some preferred, but not exclusive, embodiments of the invention will now be illustrated with reference to the accompanying drawings, in which.

Figure 1:
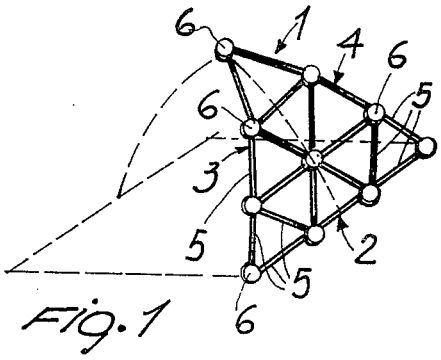
FIG. 1 is a perspective view of a triangular modular frame suitable for making a reticular structure according to the invention.
Figure 2:
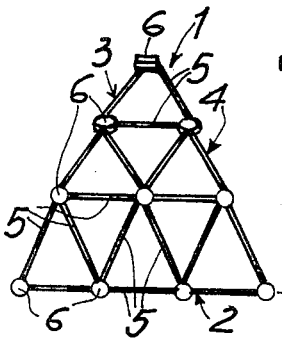
FIG. 2 is a front view of the frame of FIG. 1.
Figure 3:
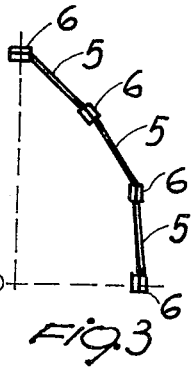
FIG. 3 is a side view of the frame of FIG. 1.

Referring to FIGS. 1, 2 and 3, there is provided a modular frame of curved section, indicated at 1, having a periphery which is substantially an equilateral triangle, of which one side 2 is straight and the other sides, 3, 4 are arcs.

In use, side 2 is arranged horizontally, while sides 3 and 4 assume an inclined position.

Frame 1 is a grid-like shell, consisting of rigid equilateral triangular meshes, which are all equal, formed from rods 5 of equal length interconnected at their ends, such rods being preferably of metal, although they can be made of any other material.

Rods 5 are connected by means of connectors 6, preferably of the type as disclosed in Italian patent application No. 23324 A/76, filed May 17, 1976, by the present applicant.

In FIGS. 1, 2 and 3, the frame 1 consists of a total of nine triangular meshes (each side having three rods 5), but it is, of course, possible to form frames with a variable number of meshes by arranging, for example, four or more rods on each side of frame 1.

In use, some rods 5 are placed horizontally, while other rods are placed obliquely; the latter ones are inscribed in geodetic lines following a helical course and at constant speed, the median vertical section of the frame 1 being inscribed in a circular arc.

Preferably, the rods 5 forming sides 2, 3 and 4 of frame 1 have larger sections than the internal rods, so that the assembly will have greater strength.

Assembling a number of frames 1, produces reticular bearing structures with square or rectangular plan.

In particular, by connecting four frames 1 so that the respective vertices are connected together at the apex, a square plan bearing structure can be formed (the base being shown by the broken line in FIG. 1).

Figure 9:
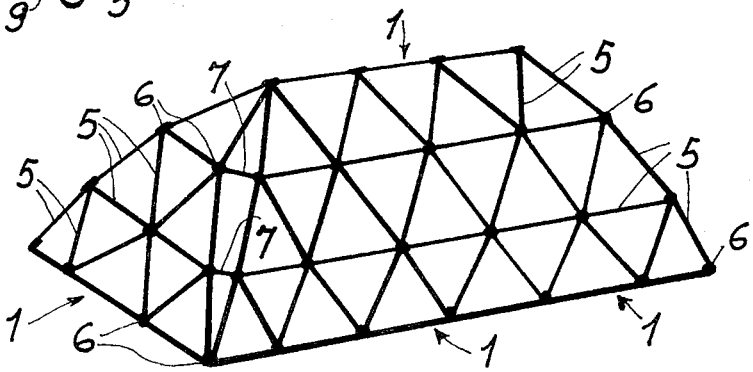
FIG. 9 is a perspective view of a reticular structure, according to the invention, which is rectangular in plan.
Figure 10:
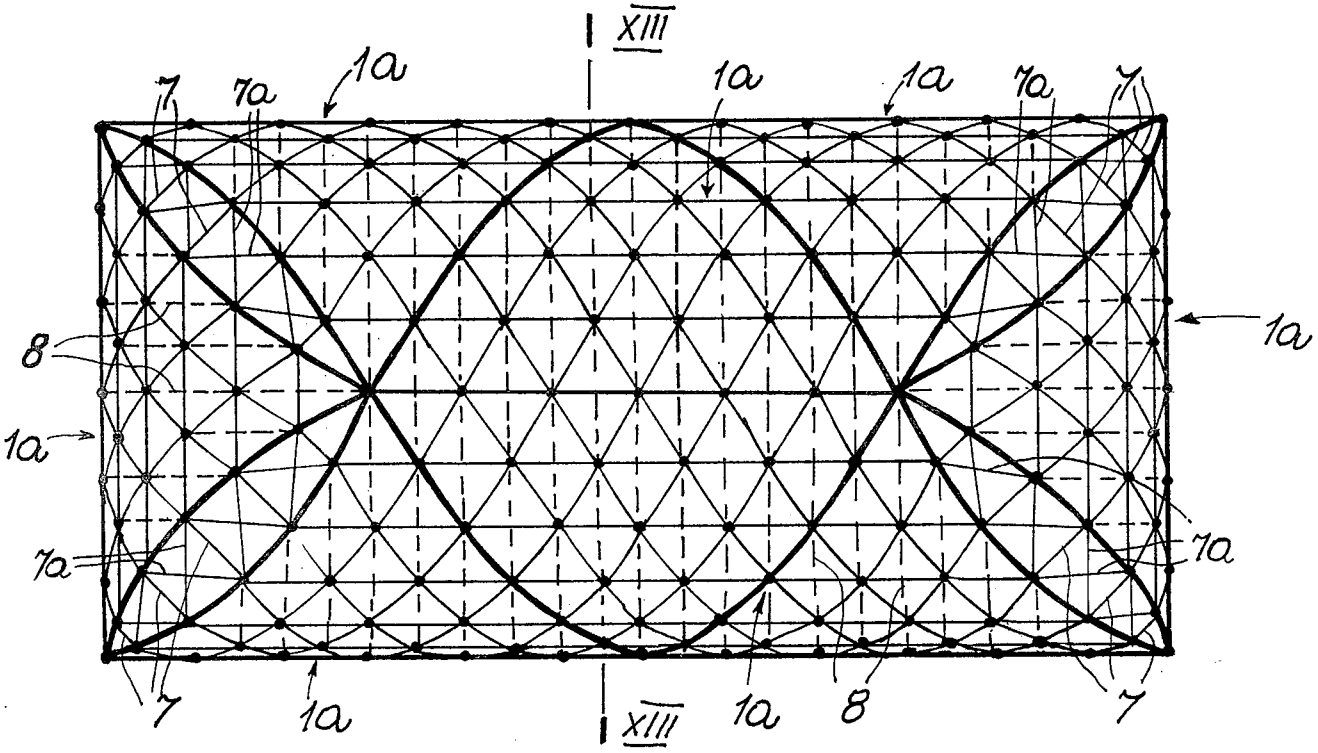
FIG. 10 is a plan view of another form of embodiment of reticular structure, according to the invention, which is rectangular in plan.
Figure 11:
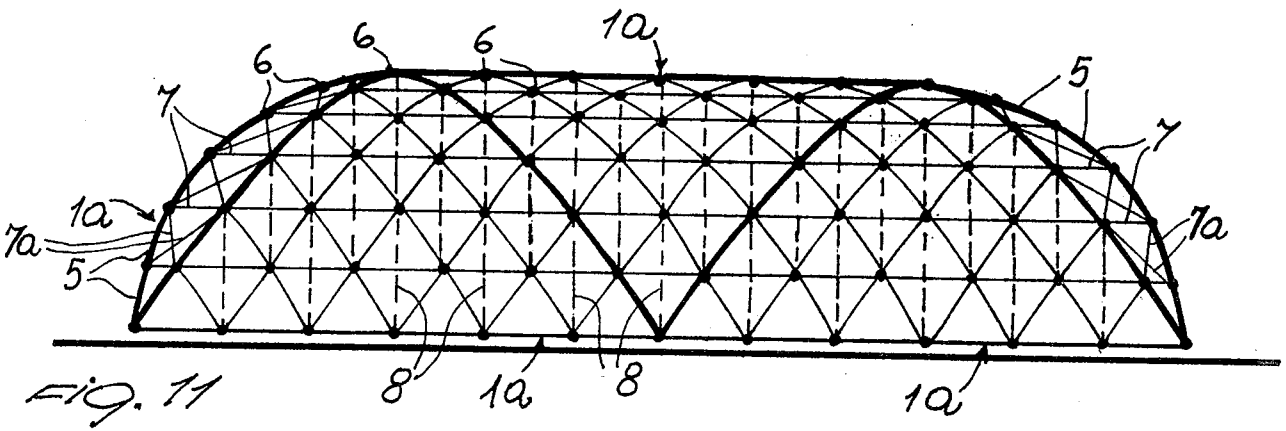
FIG. 11 is a side view of the structure of FIG. 10.
Figure 12:
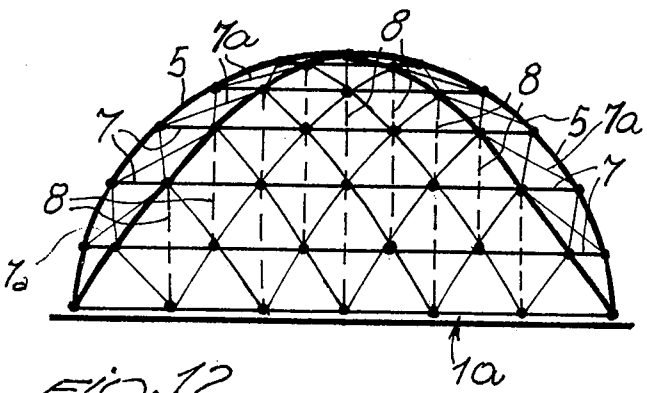
FIG. 12 is a front view of the structure of FIG. 10.
Figure 13:
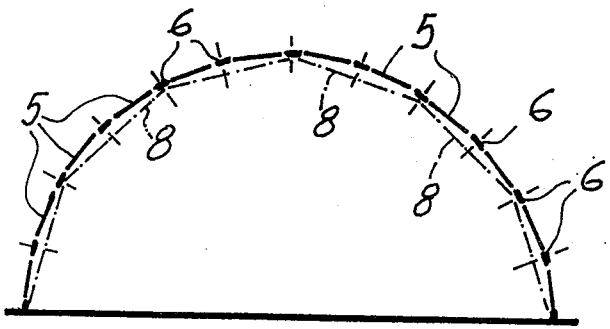
FIG. 13 is a cross section accomplished in conformance with line XIII—XIII of FIG. 10.

A reticular rectangular plan structure can, on the other hand, be made up by combining eight frames 1, as illustrated in FIG. 9, by arranging one frame for each front section and three aligned frames for each side section. The latter is formed of two frames 1 erected with the vertices at the top and another intermediate frame 1 erected with the vertex at the bottom.

By using further frames 1, the structure can be lengthened later, if required.

The structure thus formed is very light and can be easily erected by means of simple lifting equipment, while the domed shelter can be made in any style, using simple canvases or rigid infill, suitably applied in accordance with the various meshes.

Horizontal connecting rods can be fitted at the corners, as indicated at 7 in FIG. 9.

In an alternative construction, not only sides 3 and 4 of the frame 1, but also the base 2, can be of arcuate shape.

Frames 1 can furthermore be provided with a vertical median section inscribed in a quarter of a circle, so as to form bearing structures with semi-circular cross sections, as shown in FIGS. 10 to 16.

In particular, FIGS. 10 to 13 show a reticular structure rectangular in plan, consisting of eight frames 1*a*, which are linked similarly to frames 1 of FIG. 9. Frame 1*a* has a vertical median section inscribed in a quadrant and a larger number of meshes than frame 1.

Similarly as shown in the structure of FIG. 9, the sides of the structure shown in FIGS. 10 to 13 each consist of three frames 1*a* which are interaligned.

The cross section of the resulting structure (FIG. 13) is a semi-circle.

Figure 14:
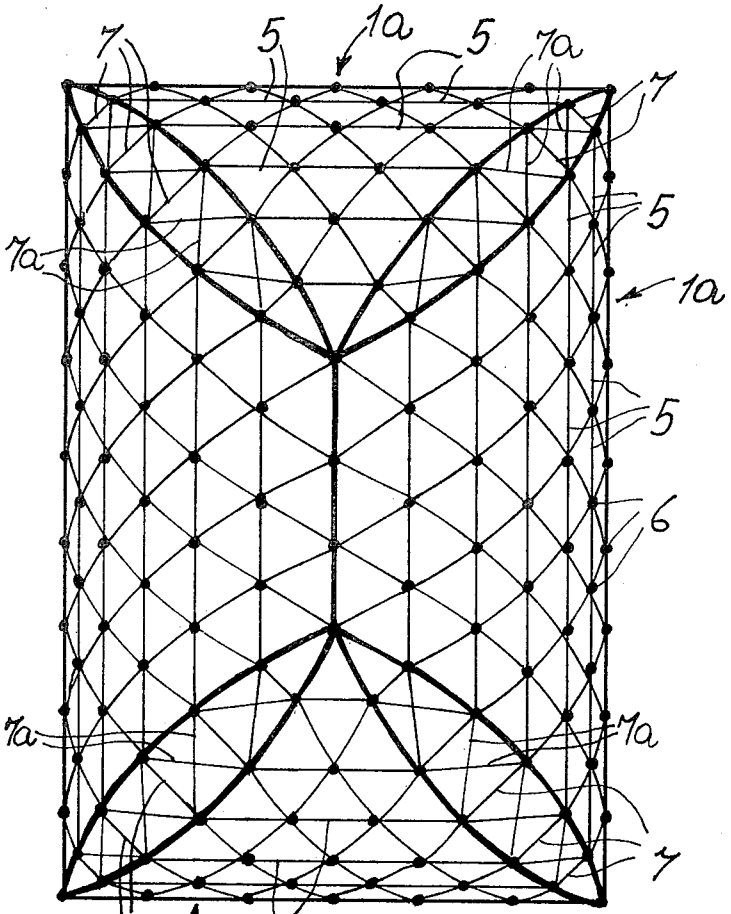
FIG. 14 is a plan view of another embodiment of the reticular structure, according to the invention, which is rectangular in plan.

In FIG. 14, there is shown, as seen from above, a rectangular plan structure of shorter length than that shown in FIGS. 10 to 13; the reduction in length is achieved by eliminating meshes from the sides.

Figure 15:
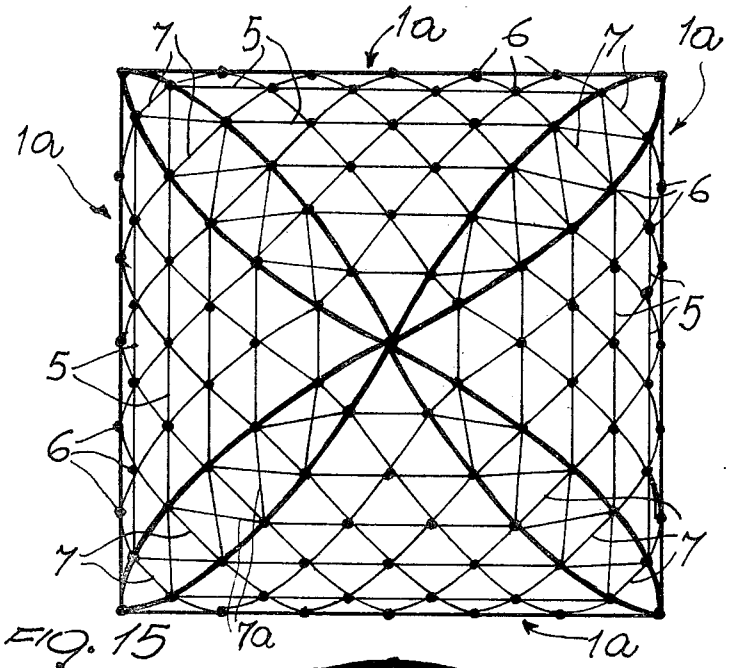
FIG. 15 is a plan view of a reticular structure, according to the invention, which is square in plan.
Figure 16:
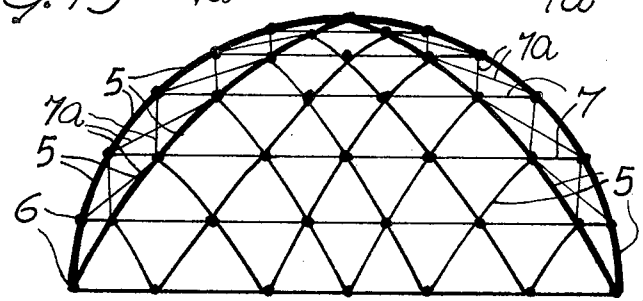
FIG. 16 is an elevational view of the structure of FIG. 15.

As shown in FIGS. 15 and 16, a square-base structure is provided, obtained by connecting four frames 1*a* having a vertical median section in the form of a quadrant. The frames 1*a* are erected with the respective vertices joined at the apex.

Horizontal connecting rods 7 (FIGS. 10 to 16) are fitted to the corners of the structure in a similar manner as provided in the structure shown in FIG. 9. Additional rods 7*a* can be fitted to the corners for greater rigidity (FIGS. 10 to 16).

According to an alternative construction, the grid structure of the above-mentioned frames can also be obtained with rhomboidal rather than triangular meshes, thus eliminating the need for the horizontal rods 5.

The various modular frames can furthermore be equipped with reinforcing tie-rods 8 (FIGS. 4 to 6 and 10 to 13).

Figure 4:
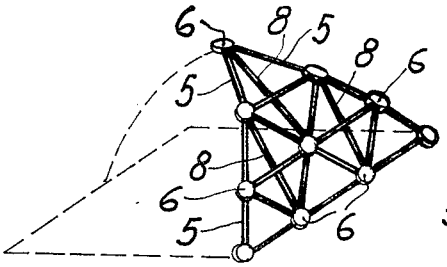
FIG. 4 is a perspective view of the frame as per the previous figures equipped with tie-rods to strengthen the reticular meshes.
Figure 5:
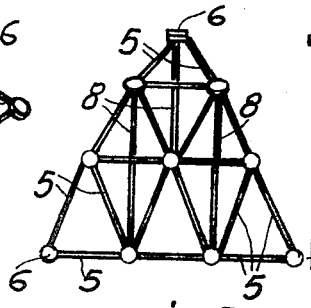
FIG. 5 is a front view of the frame of FIG. 4.
Figure 6:
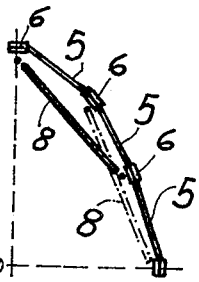
FIG. 6 is a side view of the frame of FIG. 4.

These reinforcing tie-rods 8 can be clearly seen in FIGS. 4 to 6, which illustrate the same frame 1 as shown in FIGS. 1, 2 and 3, and on which the same tie-rods were fitted, arranged in vertical planes and linking the connectors 6 of adjacent meshes. Very strong frames are achieved in this manner.

Figure 7:
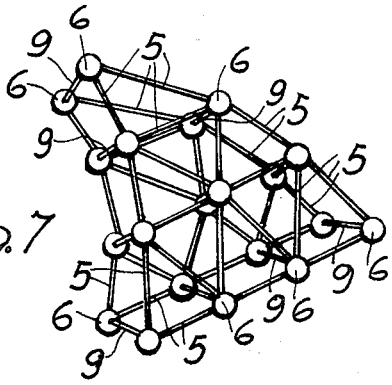
FIG. 7 is a perspective view of a triangular modular frame with a double grid-like shell, suitable for making a reticular structure according to the invention.
Figure 8:
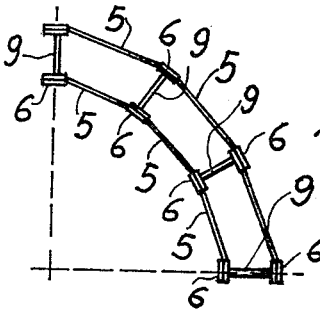
FIG. 8 is a side view of the frame of FIG. 7.

To achieve even greater strength, frames with a double grid-like shell are provided, as shown in FIGS. 7 and 8.

Each of these frames is obtained by placing alongside and parallel to the frame shown in FIGS. 1, 2 and 3, a further similar frame, the two frames being firmly connected together by means of spacing rods 9, fitted in relation to the connectors 6.

Also, in this latter case, it is possible to erect tie-rods 8 in a manner similar as shown in FIGS. 4, 5 and 6.

Obviously the double grid-like shell frames can also be formed with any desired number of meshes. It is further possible to form frames with three or more grid-like shells being arranged side by side.

As can be seen, the reticular structure of the invention is very light and at the same time rigid and permits easy construction of buildings with unlimited uses, by employing individual structural elements taking little space and of low cost, permitting easy assembling and disassembling, and which structural elements can be handled without particular machinery and large labor forces.

The distribution of the forces takes place in a very rational manner, in particular with regard to the disposition of the inclined sides of the single triangular modular frames 1, 1*a*, second geodetic lines, following a helical course, cross-linked among them, while the various reticular connections are capable of transferring the suitable forces from a connector 6 to another one by means of double curvature.

Of course, the invention is not limited solely to the examples above described, but numerous modifications and variations are possible, all coming within the scope of the invention.

Thus, for example, the reticular structure can assume, in plan, various polygonal configurations.

What is claimed is:

1. A modular reticular bearing structure for the formation of domed shelters of rectangular plan, the structure comprising a first, a second, a third and a fourth plurality of modular substantially isosceles triangular frames formed by a grid-like shell of outwardly curved section, said grid-like shell having polygonal meshes with their sides formed by oblique rigid strut-shaped elements of equal length, one joined to another at their ends by connecting joints, and being capable of being inscribed in a portion of a circular cylinder, said oblique strut-shaped elements being capable of being inscribed in crossed geodetic lines following a cylindric helix with constant pitch, said first plurality of frames extending upwardly from a first horizontal base line, said second plurality of frames and said third plurality of frames extending upwardly, respectively from second and third horizontal base lines which are parallel to one another, perpendicular to said first base line and extend from ends thereof, said fourth plurality of frames extending upwardly from a fourth base line which is parallel to said first base line, perpendicular to said second and third base lines and extends between other ends of said second and third base lines, fusiform areas being defined at respective corners of the structure between adjacent ones of said pluralities of frames.

2. A structure according to claim 1, in which the said constant pitch of the crossed geodetic lines following a cylindric helix, where the said oblique strut-shaped elements are developed, is four times the radius of the generating cylinder of the same geodetic lines.

3. A structure according to claim 1, in which each triangular modular frame has a straight base side arranged horizontally during the erection thereof with the other sides curved according to said configuration following a cylindric helix, said base side being two times the radius of the generating cylinder of the same cylindric helix.

4. A structure according to claim 1, in which each triangular modular frame has a periphery shaped as an equilateral triangle and its grid is formed by equilateral triangle equal meshes, each mesh having a side arranged horizontally after the erection according to the generating lines of the said circular cylinder, and the other oblique sides inscribed in the said geodetic lines following a helix.

5. A structure according to claim 1, in which each triangular modular frame has a periphery consisting of strut-shaped elements of greater cross section than said strut-shaped elements forming said polygonal meshes.

6. A structure according to claim 1, further comprising reinforcing tie-rods arranged in vertical planes and connecting together at least some of the joints.

7. A reticular structure according to claim 1, comprising tie-rods arranged in a vertical plane and connecting between them at least some of the vertices of said meshes.

8. A reticular structure according to claim 1, in which each of said modular frames consists of two parallel grid-like shells fastened together by means of spacer elements.

9. A structure having a reticular framework, said structure having a rectangular plan, four corners and four walls, which extend upwardly from respective horizontal base lines, each of said walls being formed of at least one modular substantially-isosceles triangular frame having a generally cylindrical-convex outwardly facing curvature, each of said frames constituting a grid-like shell of polygonal meshes, the sides of which are formed by rigid strut-shaped rods of equal length joined at their ends by connecting joints, each of said four corners being defined by respective fusiform areas between adjacent ones of said four walls.

10. A structure according to claim 9, including strut-shaped connecting elements connecting a said modular triangular frame of one wall to the closest adjacent modular triangular frame of the adjacent wall, said connecting elements extending across said fusiform areas.

* * * * *